US009040863B1

(12) United States Patent
Lyu

(10) Patent No.: US 9,040,863 B1
(45) Date of Patent: May 26, 2015

(54) AIR CIRCUIT BREAKER

(71) Applicant: HYUNDAI HEAVY INDUSTRIES CO., LTD., Ulsan (KR)

(72) Inventor: Jae Goo Lyu, Ulsan (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 0 days.

(21) Appl. No.: 14/353,068

(22) PCT Filed: Dec. 21, 2012

(86) PCT No.: PCT/KR2012/011261
§ 371 (c)(1),
(2) Date: Apr. 21, 2014

(87) PCT Pub. No.: WO2014/098288
PCT Pub. Date: Jun. 26, 2014

(51) Int. Cl.

| | |
|---|---|
| ***H01H 9/46*** | (2006.01) |
| ***H01H 33/12*** | (2006.01) |
| ***H01H 33/664*** | (2006.01) |
| ***H01H 73/18*** | (2006.01) |
| ***H01H 33/20*** | (2006.01) |

(52) U.S. Cl.
CPC ..... *H01H 33/20* (2013.01)

(58) Field of Classification Search
CPC ..... H01H 9/38; H01H 9/40; H01H 33/12; H01H 33/664; H01H 73/18
USPC ..... 218/36, 40, 148; 361/134
See application file for complete search history.

(56) References Cited

U.S. PATENT DOCUMENTS

| | | | | |
|---|---|---|---|---|
| 4,237,355 | A * | 12/1980 | Fechant et al. | 218/40 |
| 4,453,053 | A * | 6/1984 | Yamagata et al. | 218/149 |
| 5,075,520 | A * | 12/1991 | Mueller et al. | 218/36 |
| 2005/0151605 | A1 * | 7/2005 | Kruschke | 335/16 |

FOREIGN PATENT DOCUMENTS

KR 1020070085132 * 2/2009 ..... H01H 33/664

OTHER PUBLICATIONS

KR1020070085132 machine translation attached.*

* cited by examiner

*Primary Examiner* — Truc Nguyen
*Assistant Examiner* — William Bolton
(74) *Attorney, Agent, or Firm* — Sherr & Jiang, PLLC

(57) ABSTRACT

An arc guider configured to provide an arc movement path, one side thereof forming a fixation projection and a center thereof forming a groove in a longitudinal direction, a fixation element sequentially including a main contact, an arc contact being spaced apart from the main contact and an insertion groove accommodating the arc guider and a plurality of projection fixing units being formed on both sides of the insertion groove and being curved toward the accommodated arc guider through an outer force so that the fixation projection does not escape wherein triangle V shaped groove marks by the outer force are formed in the plurality of the projection fixing units.

5 Claims, 6 Drawing Sheets

AIR CIRCUIT BREAKER

CROSS REFERENCE TO PRIOR APPLICATION

This application is a National Stage Patent Application of PCT International Patent Application No. PCT/KR2012/011262 (filed on Dec. 21, 2012) under 35 U.S.C. §371, which is hereby incorporated by reference in its entirety.

TECHNICAL FIELD

This application relates to an air circuit breaker and more particularly to an air circuit breaker that may fix a fixation element and an arc guider not by welding but by bidirectional compression that may not cause the arc guider to twist or to escape from the fixation element despite an impact by a long and repetitive switching operation of the air circuit breaker.

BACKGROUND ART

Generally, an Air Circuit Breaker (ACB) is wire equipment for protecting an industry plant or generator in a building, factory or vessel.

An inner conductor of the air circuit breaker is classified into a moveable conductor and a fixable conductor and has a structure contacting and facing the moveable conductor and the fixable conductor each other while a moveable element rotates by a mechanism of a power source and a current flows in a contact unit.

FIG. 1 is a diagram illustrating a procedure of fixing a fixation element and an arc runner of a conventional air circuit breaker. Referring to FIG. 1, the conventional air circuit breaker 100 fixes a fixation contact 110 and arc runner 120 through welding.

Generally, the fixation contact 110 is made of a silver material and the arc runner 120 may also be made of a silver material for welding the fixation contact 110 and arc runner 120 thereby the fixation contact 110 and arc runner 120 may be welded by a silver solder. Therefore, the conventional air circuit breaker 100 highly costs and adds a separate welding procedure to increase a production time.

FIG. 2 is a diagram illustrating a conventional air circuit breaker fixed by using one side compression and is disclosed in Korean Patent Publication No. 10-2009-0020394.

Referring to FIG. 2, a conventional air circuit breaker 200 being fixed by one side compression includes a fixation contact 210 including a main contact 211 and an arc contact 212, an arc runner 220 including a fixation projection 221 on one side thereof and a projection fixing unit 230. The conventional air circuit breaker 200 being fixed by one side compression compresses the projection fixing unit 230 to fix the arc runner 220 to the fixation contact 210. Therefore, the conventional air circuit breaker 200 may fix the fixation contact 210 and arc runner 220 without welding like the conventional air circuit breaker 100.

However, the conventional air circuit breaker 200 may perform a number of switching operations for a long time so that an impact is applied to the fixation element 210. Therefore, the conventional air circuit breaker 200 being fixed by one side compression has a disadvantage that the arc runner 220 twists or escapes from the fixation element 210.

Therefore, an air circuit breaker being capable of fixing a fixation element and an arc runner without welding and twisting or escaping from the arc runner despite a continuous impact for the fixation element is urgently required.

Technical Problem

To solve the above described problem, this application proposes to provide an air circuit breaker that may fix a fixation element and arc guider by a bidirectional compression without welding and that may not cause the arc guider to twist or to escape from the fixation element despite an impact by a long and repetitive switching operation of the air circuit breaker.

Technical Solution

In some embodiments, an air circuit breaker includes an arc guider configured to provide an arc movement path, one side thereof forming a fixation projection and a center thereof forming a groove in a longitudinal direction, a fixation element sequentially including a main contact, an arc contact being spaced apart from the main contact and an insertion groove accommodating the arc guider and a plurality of projection fixing units being formed on both sides of the insertion groove and being curved toward the accommodated arc guider through an outer force so that the fixation projection does not escape where triangle V shaped groove marks by the outer force are formed in the plurality of the projection fixing units.

In one embodiment, in the air circuit breaker, one of the triangle V shaped groove marks is formed on a projection fixing unit being far from the arc contact below a groove of the arc guider and other of the triangle V shaped groove marks are formed on a projection fixing unit being close to the arc contact.

In one embodiment, the plurality of the projection fixing units is formed by caulking the arc contact.

In one embodiment, the plurality of the projection fixing units corresponds to a projecting part interlocking with the fixed projection.

In one embodiment, a through hole is formed on one side of the arc guider.

Technical Effects

According to an embodiment of the invention, this application has an effect where a fixation projection fixes an arc guider by a bidirectional compression thereby the arc guider does not twist or does not escape from a fixation element despite an impact by a long and repetitive switching operation.

According to an embodiment of the invention, this application has an effect where the fixation element and the arc guider is fixed without welding so that the air circuit breaker may decrease a production time and cost thereof.

MODE FOR INVENTION

Figure 1:
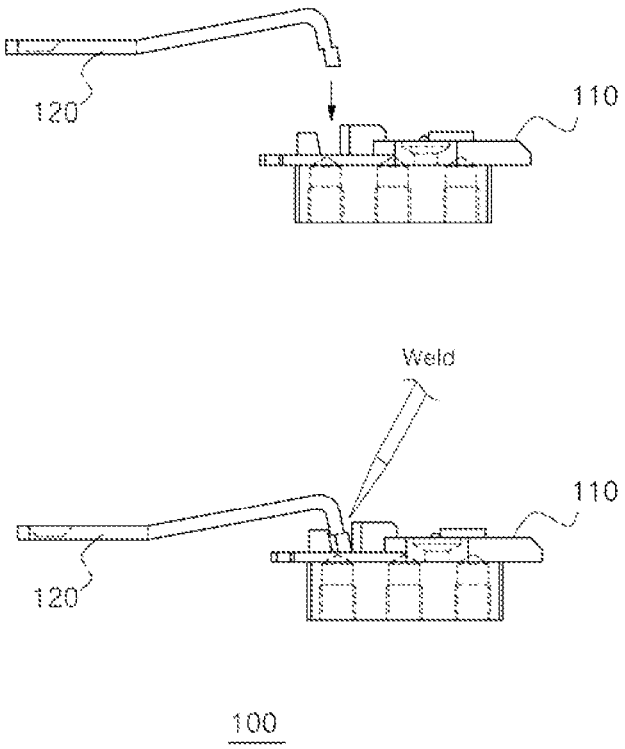
FIG. 1 is a diagram illustrating a conventional air circuit breaker.
Figure 2:
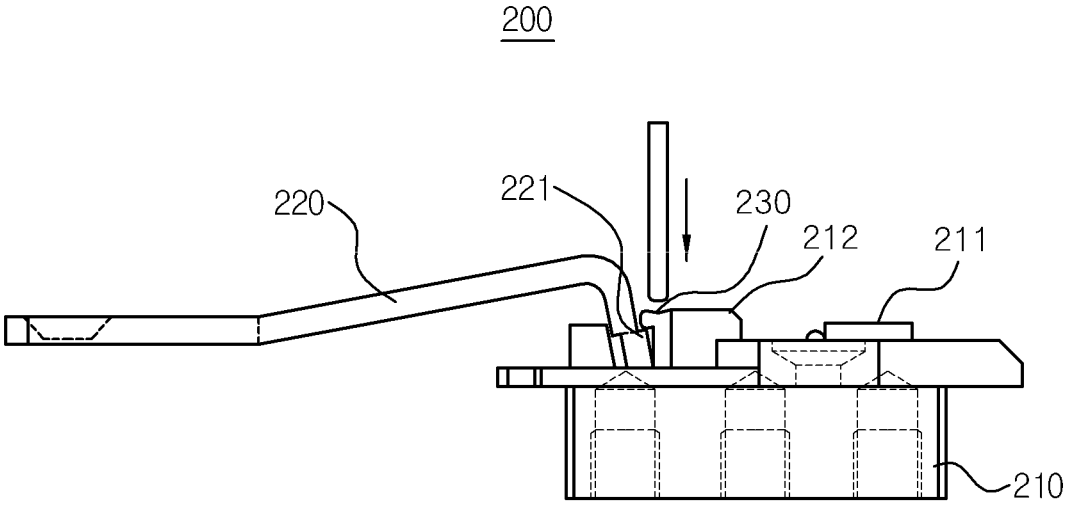
FIG. 2 is a diagram illustrating a conventional air circuit breaker fixed by using one side compression.

The embodiments and the configurations depicted in the drawings are illustrative purposes only and do not represent all technical scopes of the invention, so it should be understood that various equivalents and modifications may exist at the time of filing this application. Although a preferred embodiment of the disclosure has been described for illustrative purposes, those skilled in the art will appreciate that various modifications, additions and substitutions are possible, without departing from the scope and spirit of the invention as disclosed in the accompanying claims.

Terms and words used in the specification and the claims shall be interpreted as to be relevant to the technical scope of the invention based on the fact that the inventor may property define the concept of the terms to explain the invention in best ways.

The terms "first" and "second" can be used to refer to various components, but the components may not be limited to the above terms. The terms will be used to discriminate one component from the other component. For instance, the first component may be referred to the second component and vice versa without departing from the right of the disclosure.

The term "and/or" should be understood as including all of combination that can be made from one or more relevant items. For example, the term "the first item, the second item, and/or the third item" means not only the first, the second, or the third item, but the combination of all of items that can be made from two or more of the first, second, or third items.

When a component is referred to as being "connected to" or "linked to" another component, the component may be directly connected to or linked to another component or an intervening component may be present therebetween. In contrast, if a component is referred to as being "directly connected to" or "directly linked to" another component, an intervening component may not be present therebetween.

The terms used in the specification are for the purpose of explaining specific embodiments and have no intention to limit the disclosure. Unless the context indicates otherwise, the singular expression may include the plural expression. In the following description, the term "include" or "has" will be used to refer to the feature, the number, the step, the operation, the component, the part or the combination thereof without excluding the presence or addition of one or more features, the numbers, the steps, the operations, the components, the parts or the combinations thereof.

Unless defined otherwise, the terms including technical and scientific terms used in this specification may have the meaning that can be commonly apprehended by those skilled in the art. The terms, such as the terms defined in the commonly-used dictionary, must be interpreted based on the context of the related technology and must not be interpreted ideally or excessively.

Figure 3:
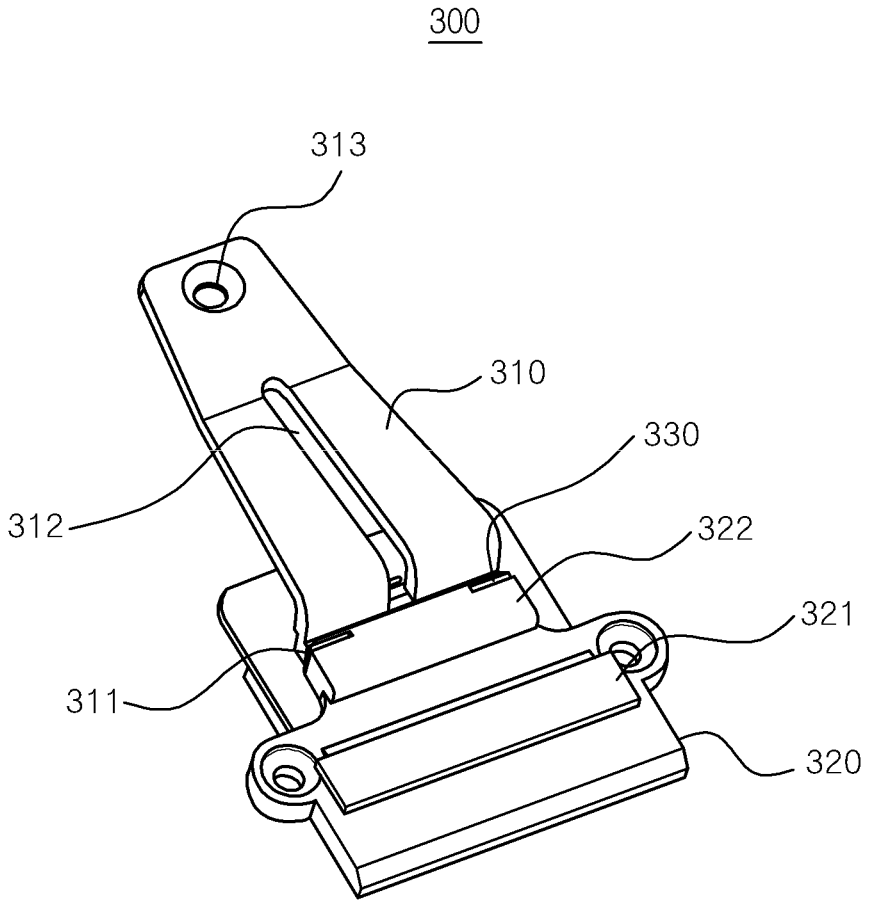
FIG. 3 is a diagram illustrating an air circuit breaker according to a disclosure of this application.

FIG. 3 is a diagram illustrating an air circuit breaker according to a disclosure of this application.

Referring to FIG. 3, an air circuit breaker 300 includes an arc guider 310 providing an arc movement path and one side thereof forming a fixation projection 311, a fixation element 320 having a main contact 321, an arc contact 322 and an insertion groove 323 and a plurality of projection fixing units 330 being formed on both sides of the insertion groove 323.

The arc guider 310 provides the movement path moving an arc generated from a fixation element 32 to an arc extinguishing part (unshown). One side of the arc guider 310 forms the fixation projection 311 and a center thereof forms a groove 312 in a longitudinal direction.

In one embodiment, the arc guider 310 may form a through hole 313 on one side of the arc guider 310 so that the arc guider 310 may be combined with a frame (unshown). In one embodiment, when the arc guider 310 is inserted in the fixation element 320, the fixation projection 311 may be formed on a contacting area where one side of the arc guider 310 and each of the plurality of the projection fixing units 330 are in contact.

The fixation element 320 is shaped with a rectangular plate and sequentially includes the main contact 321, the arc contact 322 being spaced apart from the main contact 321 and an insertion groove 323. The main contact 321 is projected from one side of the fixation element 320. The arc guider 322 is spaced apart from the main contact 321 and is projected from one side of the fixation element 320. The insertion groove 323 is formed on one side of the fixation element 320 and accommodates one side of the arc guider 310.

Figure 4:
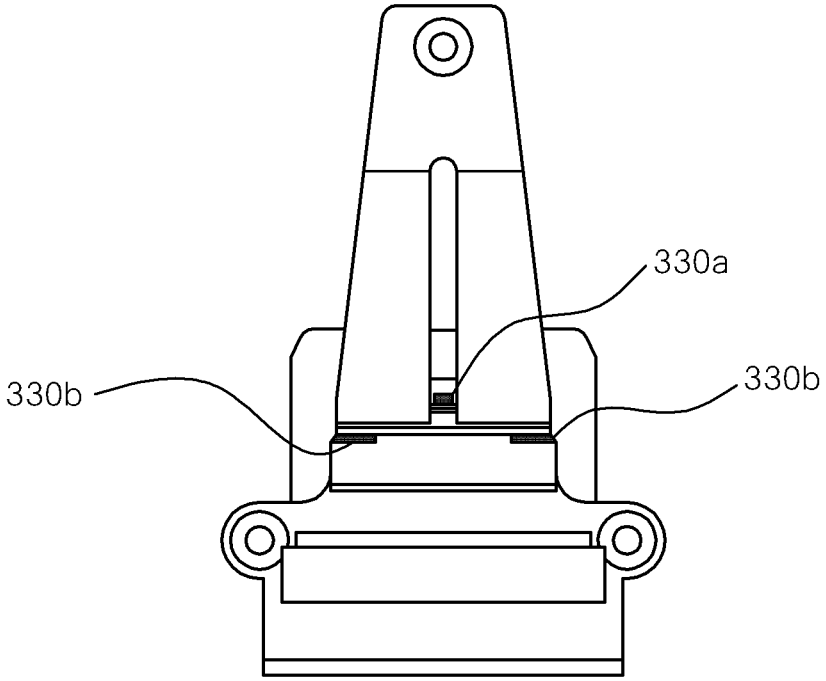
FIG. 4 is a diagram illustrating a position of a plurality of projection fixing units in FIG. 3.

FIG. 4 is a diagram illustrating a position of a plurality of projection fixing units in FIG. 3.

Referring to FIG. 4, the plurality of the projection fixing units 330 is formed on both sides of the insertion groove 323. The plurality of the projection fixing units 330 is curved toward the accommodated arc guider 310 through an outer force so that the fixation projection 311 may not escape by the plurality of the curved projection fixing units 330. Triangle V shaped groove marks 331 by the outer force are formed in the plurality of the projection fixing units 330.

In one embodiment, one of the triangle V shaped groove marks may be formed on a projection fixing unit 330*a* being far from the arc contact 322 and being below a groove of the arc guider 310 and other triangle V shaped groove marks may be formed on a projection fixing unit 330*b* being close to the arc contact 322. In one embodiment, the plurality of the projection fixing units 330 may be formed by caulking the arc contact 310. In one embodiment, the plurality of the projection fixing units 330 corresponds to a projecting part interlocking with the fixation projection 311.

Therefore, the air circuit breaker 300 fixes the arc guider 310 by a bidirectional compression so that the arc guider 310 may not twist or may not escape from the fixation element 320 despite a long and repetitive switching operation.

Figure 5:
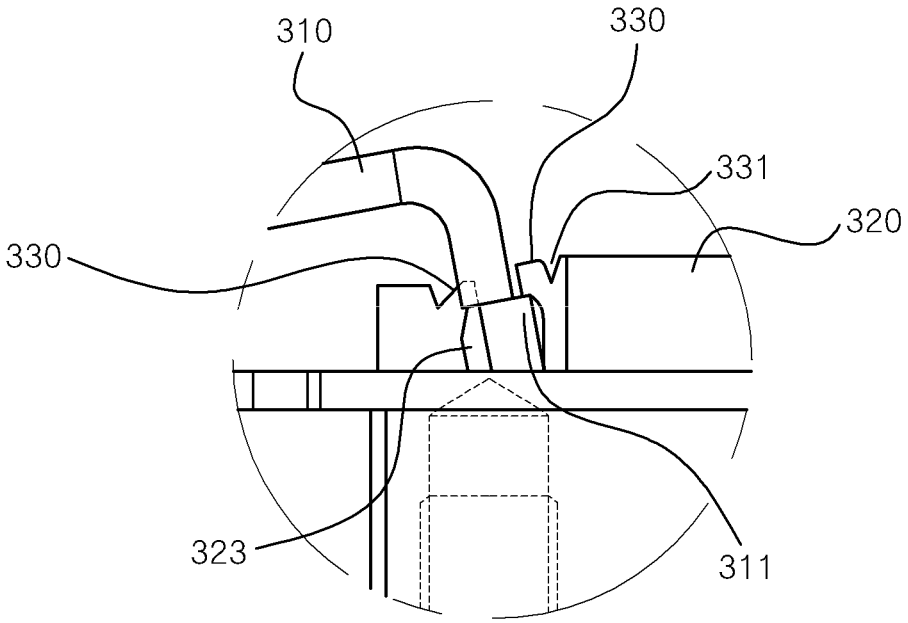
FIG. 5 is a diagram illustrating a procedure of fixing a fixation element and arc guider of an air circuit breaker in FIG. 3.
Figure 6:
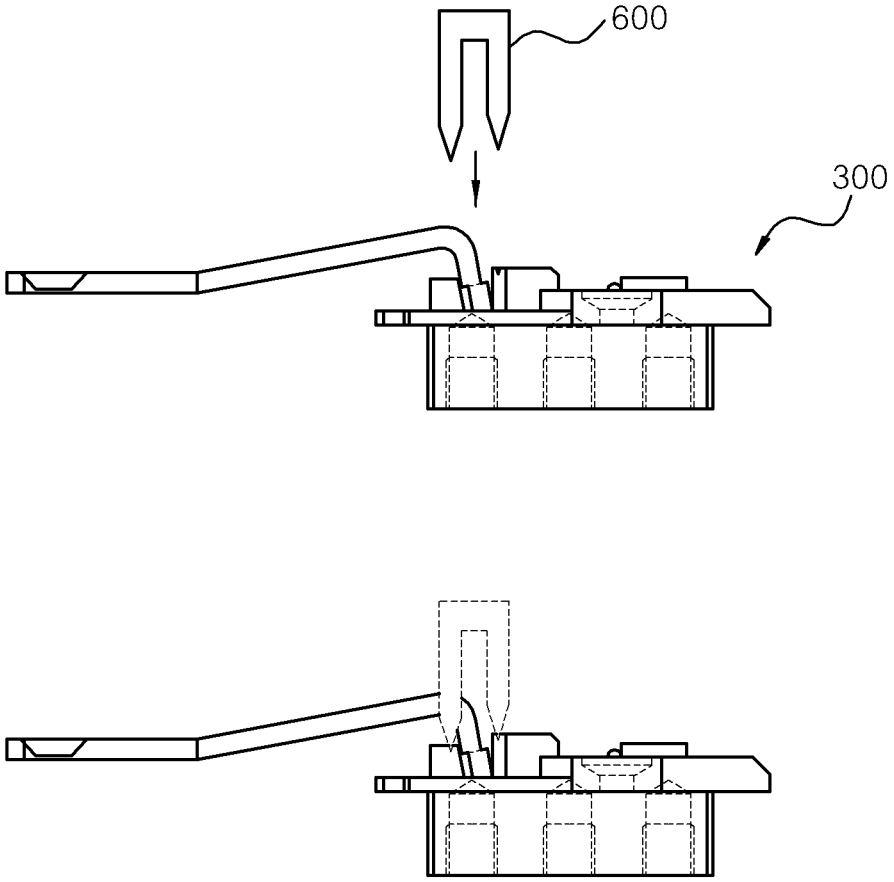
FIG. 6 is a perspective enlargement view illustrating a plurality of projection fixing units.

FIG. 5 is a diagram illustrating a procedure of fixing a fixation element and arc guider of an air circuit breaker in FIG. 3 and FIG. 6 is a perspective enlargement view illustrating a plurality of projection fixing units.

Referring to FIG. 5 and FIG. 6, when the arc guider 310 is inserted in the insertion groove 323 of the fixation element 320 and the plurality of the projection fixing units 330 is compressed with a triangle header shaped compressing jig 600, the plurality of the projection fixing units 330 forms the triangle V shaped groove marks 331 and is curved toward the accommodated arc guider 310. The plurality of the curved projection fixing units 330 fixes the fixation element 311 so that the fixation element 311 may not escape.

Therefore, the air circuit breaker 300 fixes the arc guider 310 by a bidirectional compression so that the arc guider 310 may not twist or may not escape from the fixation element 320 despite an impact by the long and repetitive switching operation.

Furthermore, the air circuit breaker fixes the fixation element and the arc guider without welding so that the air circuit breaker may decrease a production time and cost thereof.

Although embodiments have been described with reference to a number of illustrative embodiments thereof, it should be understood that numerous other modifications and embodiments can be devised by those skilled in the art that will fall within the spirit and scope of the principles of this disclosure.

The invention claimed is:

1. An air circuit breaker comprising:

an arc guider configured to provide an arc movement path, one side thereof forming a fixation projection and a center thereof forming a groove in a longitudinal direction;

a fixation element sequentially including a main contact, an arc contact being spaced apart from the main contact and an insertion groove accommodating the arc guider; and a plurality of projection fixing units being formed on both sides of the insertion groove and being curved toward the accommodated arc guider through an outer force so that the fixation projection does not escape wherein triangle V shaped groove marks by the outer force are formed in the plurality of the projection fixing units.

2. The air circuit breaker of claim 1, wherein one of the triangle V shaped groove marks is formed on a projection fixing unit being far from the arc contact below a groove of the arc guider and other triangle V shaped groove marks are formed on a projection fixing unit being close to the arc contact.

3. The air circuit breaker of claim 1, wherein the plurality of the projection fixing units is formed by caulking the arc contact.

4. The air circuit breaker of claim 3, wherein the plurality of the projection fixing units corresponds to a projecting part interlocking with the fixation projection.

5. The air circuit breaker of in claim 1, wherein a through hole is formed on one side of the arc guider.

* * * * *